US008189831B2

(12) United States Patent
Sörgel

(10) Patent No.: US 8,189,831 B2
(45) Date of Patent: May 29, 2012

(54) HEARING AID HAVING AN AUDIO SIGNAL GENERATOR AND METHOD

(75) Inventor: Wolfgang Sörgel, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1335 days.

(21) Appl. No.: 11/888,883

(22) Filed: Aug. 2, 2007

(65) Prior Publication Data

US 2008/0031479 A1 Feb. 7, 2008

(30) Foreign Application Priority Data

Aug. 4, 2006 (DE) ..... 10 2006 036 583

(51) Int. Cl.
*H04R 25/00* (2006.01)

(52) U.S. Cl. ..... 381/312; 381/317; 381/328; 381/330; 381/380

(58) Field of Classification Search ..... 381/312, 381/317, 318, 328, 330, 380, 381
See application file for complete search history.

(56) References Cited

U.S. PATENT DOCUMENTS

| | | | | |
|---|---|---|---|---|
| 5,210,803 | A | 5/1993 | Martin et al. | |
| 7,149,319 | B2 | 12/2006 | Roeck | |
| 2002/0021814 | A1* | 2/2002 | Roeck | 381/312 |
| 2007/0084331 | A1* | 4/2007 | Haken | 84/600 |

FOREIGN PATENT DOCUMENTS

| | | | |
|---|---|---|---|
| EP | 0 480 097 | A1 | 4/1992 |
| WO | WO 01/30127 | A2 | 5/2001 |

* cited by examiner

*Primary Examiner* — Kenneth Parker
*Assistant Examiner* — Dale E Page

(57) ABSTRACT

The invention relates to a hearing aid having an audio signal unit which is operatively connected to a sound generator and generates an audio signal which has at least two audio signal sections immediately succeeding one another in time. The audio signal sections each have an audio signal section duration and the audio signal has at least one frequency that is audible to the human ear. The audio signal sections succeed one another in such a way that an audio signal section succeeding a previous audio signal section in time begins before the previous audio signal section has terminated, with the result that the previous and the succeeding audio signal section overlap one another with an overlapping time period, the overlapping time period being shorter than the audio signal section duration of the previous audio signal section.

11 Claims, 2 Drawing Sheets

HEARING AID HAVING AN AUDIO SIGNAL GENERATOR AND METHOD

CROSS REFERENCE TO RELATED APPLICATIONS

This application claims priority of German application No. 10 2006 036 583.6 filed Aug. 4, 2006, which is incorporated by reference herein in its entirety.

FIELD OF THE INVENTION

The invention relates to a hearing aid having at least one sound receiver and a sound generator.

BACKGROUND OF THE INVENTION

With hearing aids known from the prior art a user interface is known which is embodied to generate a signal tone or an acknowledgement tone as a function of a user interaction or as a function of a predefined event. For example, the hearing aid known from the prior art can confirm a successful switch to another hearing program by means of an acknowledgement tone.

Said acknowledgement tone can be played back via the sound generator of the hearing aid.

With the hearing aids known from the prior art there is the problem that signal tones or acknowledgement tones of said kind can be perceived as unpleasant by a user of the hearing aid known from the prior art. WO 01/30127 A2 discloses a hearing aid which can make time-limited audio signals available on user-replaceable memory elements. With this arrangement different audio signal patterns are provided for an audio signal. Each of the audio signals is time-limited and in each case can be generated as an acknowledgement signal in response to a control signal. The user can program the audio signals owing to the fact that corresponding audio signal patterns can be loaded into a memory of the hearing aid. Sequences of beep signals are also provided as acknowledgement signals.

SUMMARY OF THE INVENTION

The object underlying the invention is therefore to disclose a hearing aid that is improved in terms of the above-cited problem.

This object is achieved by means of a hearing aid as claimed in the claims having at least one sound receiver and a sound generator, the at least one sound receiver being embodied to receive sound waves and to generate a microphone signal which represents the received sound waves.

The hearing aid also has a transmission unit which is connected on the input side to at least one sound receiver and on the output side to the sound generator. The transmission unit is embodied to receive the microphone signal on the input side and to generate, as a function of the microphone signal received on the input side, a power signal which at least partially represents the microphone signal.

The sound generator is embodied to receive the power signal on the input side and to generate, as a function of the power signal received on the input side, a sound which corresponds to the power signal. The hearing aid also has an audio signal unit which is operatively connected to the sound generator and is embodied to generate an audio signal which has at least two audio signal sections succeeding one another immediately in time.

The audio signal sections each have an audio signal section duration and the audio signal has at least one frequency that is audible to a human ear.

The audio signal sections succeed one another in such a way that an audio signal section succeeding a previous audio signal section in time begins before the previous audio signal section has terminated, with the result that the previous and the succeeding audio signal section overlap one another with an overlapping time period, the overlapping time period being shorter than the audio signal section duration of the previous audio signal section.

Owing to an overlapping in time of audio signal sections succeeding one another immediately in time, tones represented in each case by the audio signal sections for example are perceived as pleasant by a user of the hearing aid. It has been recognized according to the invention, namely, that each audio signal section has an end, with in particular an abrupt ending of an audio signal section often representing a jump signal whose switch-off clicking may be experienced as unpleasant by a user of the hearing aid.

An overlapping of the audio signal sections advantageously results in such an abrupt termination of a previous audio signal section not occurring. Tones succeeding one another in time can be perceived as a melody.

In an advantageous embodiment of the hearing aid the audio signal unit has an input for an event signal and is embodied to generate the audio signal as a function of said event signal. The event signal can be generated by the hearing aid for example if a battery charge level of a connected battery falls below a predefined value. In this embodiment the audio signal can represent a warning signal for example.

An event signal can preferably be generated by the hearing aid as a function of a user interaction signal as an acknowledgement of a user interaction.

In a preferred embodiment of the hearing aid the audio signal section has an end section, an amplitude envelope of the end section having a falling amplitude characteristic.

As a result, a tone decaying with a falling amplitude envelope or another noise represented by an audio signal section is advantageously perceived as pleasant by a user of the hearing aid, since the tone or noise releases gradually. For example, an audio signal section can represent a tone played on a musical instrument, in particular a piano, a harpsichord or a tone produced by plucking a guitar string.

In this embodiment a gradually decaying of an amplitude envelope is perceived as pleasant.

In a preferred embodiment the amplitude envelope of the end section has an exponentially falling amplitude characteristic.

In a preferred embodiment variant of the hearing aid, the overlapping time period is shorter than the end section of the previous audio signal section. For example, if a previous audio signal section represents a tone produced by striking a key of a piano, it is experienced as pleasant by a user of the hearing aid if a succeeding audio signal section which likewise represents another tone produced by means of a piano, the second tone beginning during a decay phase of the first tone struck.

An audio signal section can of course also represent other tones:

Thus, for example, tones produced by percussion instruments, in particular a metallophone tone, a xylophone tone, a gong tone, a bell tone, a tone produced by a string instrument, a tone produced by a wind instrument or a tone produced by a synthesizer are conceivable.

Thus, for example, audio signal sections succeeding one another immediately in time can each represent a tone with tone pitches that are different from one another, with the result that the audio signal represents a melody.

In a preferred embodiment the audio signal section has a start section, an amplitude envelope of the start section having an in particular linearly rising amplitude characteristic. In this way a natural sound impression of a tone played by an instrument can advantageously be produced.

In a further preferred embodiment the audio signal section has a constant section with a characteristic of an amplitude envelope that is constant over time. By this means an undamped oscillation of a tone can advantageously be produced.

In an advantageous embodiment the audio signal section represents a tone having a predefined fundamental frequency. The audio signal section further preferably represents a plurality of harmonics of the tone having the predefined fundamental frequency. In this way a sound quality of a tone can advantageously be produced.

In a preferred embodiment the audio signal section represents a tone produced by at least one musical instrument or by a human voice. For example, an audio signal section can represent a tone produced by two voices, by three voices or polyphonically.

In an advantageous embodiment of the hearing aid the audio signal unit has at least two tone signal generators, each of which is embodied to generate at least one audio signal section.

The audio signal unit is further preferably embodied to control the at least two tone signal generators alternately with respect to one another and thus to generate the audio signal. In this way an audio signal can advantageously be generated by means of a memory-saving and low-overhead method.

The audio signal unit is further preferably embodied to generate the audio signal section by means of frequency modulation synthesis. In this way a clean sounding tone can advantageously be produced in a memory-saving manner, said tone representing for example a tone of a musical instrument. A memory space requirement for a tone held available in this way can advantageously amount to up to a tenth of a memory space requirement for a tone formed from sampled values.

In another embodiment the hearing aid has a memory for at least one audio signal section, the audio signal section being formed from sampled values, each of which represents an audio signal amplitude value of the audio signal section at a sampling instant. In this way an audio signal section can represent virtually any tones or noises.

The invention also relates to a method for generating an audio signal by means of a hearing aid, the audio signal comprising at least two audio signal sections and representing at least one frequency which can be perceived by a human ear.

The method comprises the steps:

generating an audio signal section having a predefined audio signal section duration;

generating an audio signal section succeeding in time, the succeeding audio signal section beginning before the audio signal section has terminated;

generating the audio signal from the audio signal sections.

Further advantageous embodiment variants of the invention will emerge from the features described in the dependent claims or from a combination thereof.

BRIEF DESCRIPTION OF THE DRAWINGS

The invention will now be explained below with reference to figures and further exemplary embodiments.

DETAILED DESCRIPTION OF THE INVENTION

Figure 1:
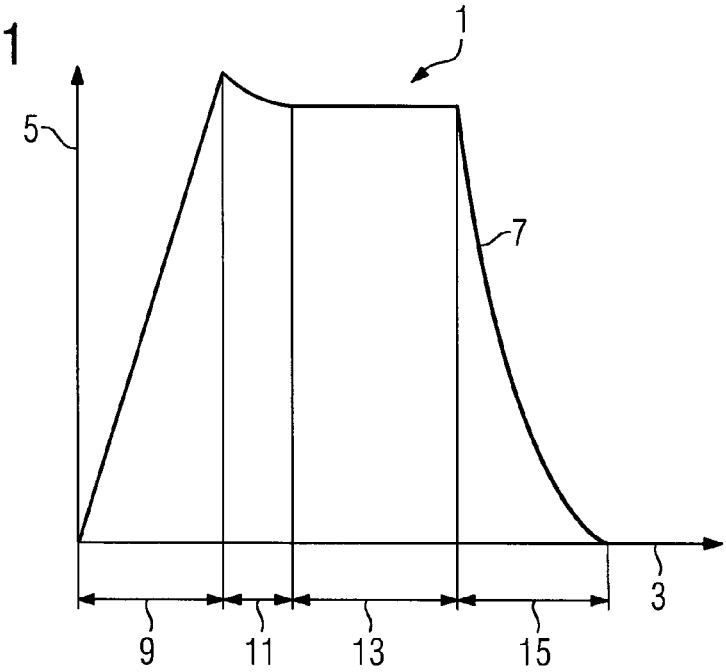
FIG. 1 schematically shows an exemplary embodiment for an audio signal section.

FIG. 1 shows a schematic diagram 1. The diagram 1 shows a graph 7 which represents an amplitude envelope of an audio signal section. In this embodiment the audio signal section has four phases which are each different with respect to one another, namely an attack phase, a decay phase, a sustain phase and a release phase.

Diagram 1 has an abscissa 3 and an ordinate 5. A time is plotted on the abscissa 3 and an audio signal amplitude is plotted on the ordinate 5.

Time sections 9, 11, 13 and 15 are marked on the abscissa 3. Time section 9 represents an attack phase of the audio signal section. Time section 11 represents a decay phase of the audio signal section. Time section 13 represents a sustain phase of the audio signal section. Time section 15 represents a release phase of the audio signal section, in which release phase the amplitude envelope has a falling characteristic.

Figure 2:
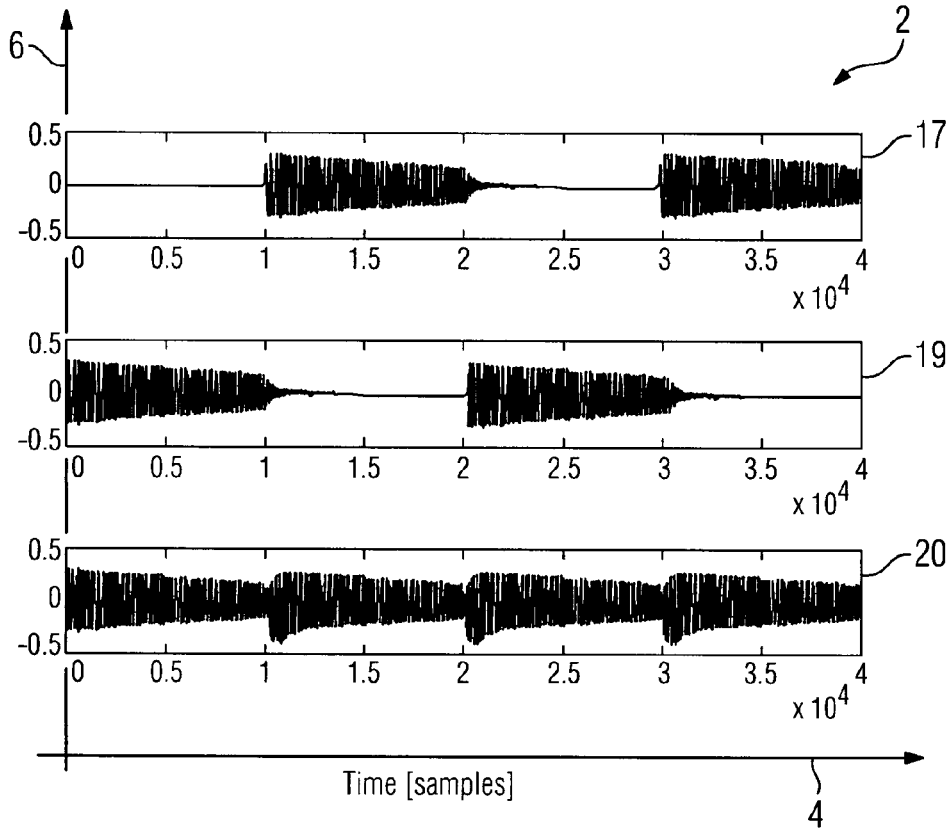
FIG. 2 schematically shows an exemplary embodiment for audio signals.

FIG. 2 shows a schematic diagram 2 in which three signal amplitude characteristics are represented as a function of time. The figure depicts audio signal sections 17 generated by a first tone signal generator, audio signal sections 19 generated by a second tone signal generator and an audio signal 20 which is formed from the audio signal sections 17 and 19.

Diagram 2 has an abscissa 4 and an ordinate 6, where the abscissa 4 represents a variation with time and the ordinate 6 represents signal amplitude values in each case for the audio signal sections 17 and 19 and for the audio signal 20.

The variation with time is plotted on the abscissa 4 in sampled values, where the variation with time comprises 40,000 sampled values. The audio signal sections 19 generated by the second tone signal generator are formed from an audio signal section which extends between a sampled value 0 and a sampled value 15,000. An end section of the audio signal section with a falling amplitude characteristic extends between a sampled value 10,000 and the sampled value 15,000, said end section corresponding to the time section 15 shown in FIG. 1 with falling amplitude envelope characteristic.

At the time of the sampled value 10,000 there begins an audio signal section of the audio signal sections 17 generated by the first tone signal generator, said audio signal section extending up to a sampled value 25,000.

At a sampled value 20,000 there begins an audio signal section which has been generated by the second tone signal generator and which extends to a sampled value 35,000. At the time of the sampled value 30,000 there begins an audio signal section which has been generated by the first tone signal generator.

The audio signal 20 represents a summation signal which is generated by adding together the audio signal section 17 generated by the first tone signal generator and the audio signal section 19 generated by the second tone signal generator.

Immediately succeeding audio signal sections of the audio signal 20 are in each case generated in alternation by the first and the second tone signal generator.

The audio signal sections can in each case represent tones produced by a musical instrument for forming a melody. The audio signal 20 can thus represent the melody, comprising four tones in this exemplary embodiment.

Figure 3:
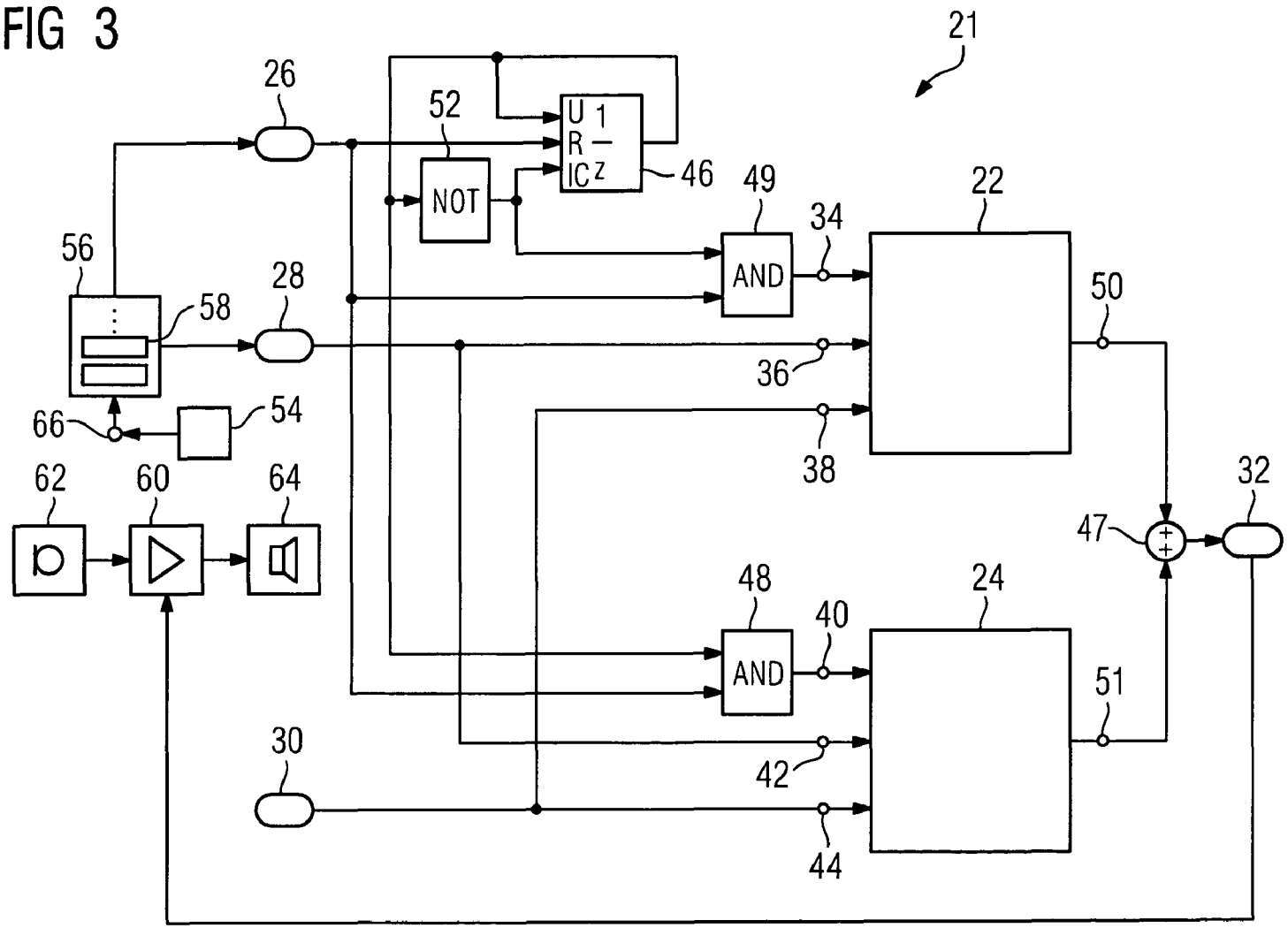
FIG. 3 schematically shows a circuit arrangement for a hearing aid having two interconnected tone signal generators, each of which is a component of an audio signal unit of the hearing aid.

FIG. 3 is a schematic showing an exemplary embodiment for a hearing aid having two interconnected tone signal generators, each of which can be a component of an audio signal unit and which are provided for generating an audio signal, for example the audio signal 20 shown in FIG. 2.

A circuit arrangement 21 for a hearing aid depicted in FIG. 3 has a first tone signal generator 22 and a second tone signal generator 24. The tone signal generator 22 has a trigger input 34, a frequency input 36 and a level input 38. The second tone signal generator 24 has a trigger input 40, a frequency input 42 and a level input 44.

The first tone signal generator 22 has a signal output 50, and the second tone signal generator 24 has a signal output 51. The tone signal generators 22 and 24 are each embodied to generate, as a function of a trigger signal received on the input side, an audio signal section which has at least one frequency which can be perceived by a human ear. The audio signal section has an amplitude envelope which can have an amplitude time characteristic corresponding to the curve 7 shown in FIG. 1.

The tone signal generators 22 and 24 are in each case embodied to generate the audio signal section with a fundamental frequency, the fundamental frequency in each case being dependent on a control signal received on the frequency input side.

The tone signal generators 22 and 24 are therefore embodied to generate a fundamental frequency of the generated audio signal section as a function of a control signal received on the input side. For example, harmonics can further advantageously be generated in addition by the tone signal generators 22 and 24 as a function of the control signal.

The tone signal generator 22 is embodied to generate a volume level of the audio signal section as a function of a level signal received on the input side. The level signal can be received at the level input 38. The tone signal generator 24 is embodied in a corresponding manner to the tone signal generator 22 and can receive a level signal on the input side via the level input 44.

The tone signal generators 22 and 24 are in each case connected on the output side to a summation element 47. Said summation element 47 is connected on the input side to the signal output 50 and the signal output 51 and on the output side to an output 32 of the circuit arrangement 21. The summation element 47 is embodied to add signals received on the input side to one another and thereby form a summation signal and output said summation signal on the output side.

The circuit arrangement 21 has a flip-flop circuit which is formed by means of a selection gate 46, an AND gate 48, an AND gate 49 and a NOT gate 52. The trigger circuit has a trigger input 26 which forms a trigger input of the circuit arrangement 21.

The AND gate 48 is connected on the output side to the trigger input 40 of the second tone signal generator 24. The AND gate 49 is connected on the output side to the trigger input 34 of the first tone signal generator 22. A first input of the AND gate 48 is connected to the trigger input 26 and a first input of the AND gate 49 is connected to the trigger input 26.

The selection gate 46 has a signal input u, a reset input R and an input IC for a start condition. The selection gate 46 has a transfer function which corresponds to a time delay.

The reset input of the selection gate 46 is connected to the trigger input 26. The selection gate 46 is fed back on the output side to the signal input u and connected on the output side to an input of the NOT gate 52 and to a second input of the AND gate 48. The NOT gate 52 is connected on the output side to the input for a start condition of the selection gate 46 and to a second input of the AND gate 49.

Feeding back the selection gate 46 leads to a hold gate being formed. If a trigger signal is present for example at the trigger input 26, the selection gate 46 is reset via the reset input and a logically positive output signal is generated which is sustained as a result of the feeding back.

The output signal is now present on the input side at the NOT gate 52 and at the second input of the AND gate 48. On the output side the NOT gate 52 generates a logically negative signal which is present at the second input of the AND gate 49. The—logically positive—trigger signal of the trigger input 26 is present in each case at the first inputs of the AND gates 48 and 49. In this way a through-connect condition of the AND gate 48 is established and an output signal of the AND gate 48 can form a trigger signal for the second tone signal generator 24 which is present at the trigger input 40.

If a logically positive trigger signal is re-applied to the trigger input 26, the selection gate 46 is reset, with the start condition, controlled by the input IC, being logically negative. In this way a logically negative output signal is generated which is sustained by the feedback via the signal input u. The logically negative output signal is now present on the input side at the NOT gate 52 and at the second input of the AND gate 48.

The AND gate 48 is now driven logically positive on the input side by the NOT gate 52 and logically negative by the logically negative output signal and therefore switches to a blocking state.

Two logically positive signals are present on the input side at the AND gate 49, with the result that the AND gate 49 generates an output signal which is present at the trigger input 34 of the tone signal generator 22 and can therefore form a trigger signal for the tone signal generator 22.

Triggered by the trigger signal thus generated, the tone signal generator 22 can now generate an audio signal section and output this on the output side via the output 50.

By means of the above-described flip-flop circuit an audio signal, formed from audio signal sections, can be generated in this way by the tone signal generators 22 and 24—alternately in each case.

The circuit arrangement 21 also has a frequency input 28 and a level input 30. The frequency input 28 is connected to the frequency input 36 of the first tone signal generator 22 and to the frequency input 42 of the second tone signal generator 24.

The level input 30 is connected to the level input 38 of the first tone signal generator 22 and to the level input 44 of the second tone signal generator 24. In this way the tone signal generators 22 and 24, in each case when activated by means of a trigger signal, can generate an audio signal section with a fundamental frequency which corresponds to a frequency signal present on the input side at the frequency input 28 of the circuit arrangement 21.

An output level—and hence a volume of the generated audio signal section—can be controlled via the level inputs 38 and 44 such that an output level and consequently a maximum amplitude of the audio signal section generated in each case corresponds to a level signal present at the level input 30.

The circuit arrangement 21 also has a control unit 54 and a melody generator 56 which has an input 66 for an event signal and is connected on the input side to the control unit 54. The melody generator is connected on the output side to the frequency input 28 and to the trigger input 26. The melody generator 56 can keep at least one melody data record 58 representing a melody available and decode said data record as a function of an event signal received on the input side and generate frequency signals corresponding to the melody for the purpose of generating corresponding audio signal sections and output said frequency signals on the output side.

The melody generator 56 can generate a trigger signal for each audio signal section to be generated and output said trigger signal to the trigger input 26. The circuit arrangement also has a transmission unit 60, a sound receiver 62 and a sound generator 64, each of which is connected to the transmission unit 60. The mode of operation of the transmission unit 60, the sound generator 64 and the sound receiver 62 is as described already in the foregoing. The transmission unit 60 is connected on the input side to the output 32 and can generate a power signal which corresponds to an audio signal received from the output 32 and output said power signal to the sound generator 64.

The invention claimed is:

1. A hearing aid, comprising:

a sound receiver that receives sound waves and generates a microphone signal representing the sound waves;

a transmission unit that receives the microphone signal and generates a power signal representing the microphone signal;

a sound generator that receives the power signal and generates a sound based on the power signal; and an audio signal unit that is operatively connected to the sound generator and generates an audio signal comprising a plurality of audio signal sections immediately succeeding one another in time, wherein a succeeding audio signal section is overlapped with a previous audio signal section by an overlapping time period that is shorter than an audio signal section duration of the previous audio signal section, wherein the audio signal unit comprises a plurality of tone signal generators that alternatively generate the immediately succeeding audio signal sections of the audio signal, and wherein the hearing aid further comprises a summation element operatively connected to the plurality of tone signal generators that sums the immediately succeeding audio signal sections in time and outputs the summed audio signal to the transmission unit.

2. The hearing aid as claimed in claim 1, wherein the audio signal comprises a frequency that is audible to a human ear.

3. The hearing aid as claimed in claim 1, wherein the audio signal unit generates the audio signal as a function of an event signal.

4. The hearing aid as claimed in claim 1, wherein the audio signal sections each comprises an end section and an amplitude envelope of the end section having a falling amplitude characteristic.

5. The hearing aid as claimed in claim 1, wherein the audio signal sections each comprises a start section and an amplitude envelope of the start section having a rising amplitude characteristic.

6. The hearing aid as claimed in claim 1, wherein the audio signal sections each comprises a constant section with a characteristic of an amplitude envelope that is constant over time.

7. The hearing aid as claimed in claim 1, wherein the audio signal sections each represents a tone having a predefined fundamental frequency.

8. The hearing aid as claimed in claim 7, wherein the audio signal sections each represents a plurality of harmonics of the tone.

9. The hearing aid as claimed in claim 1, wherein the audio signal section each represents a tone produced by a musical instrument.

10. The hearing aid as claimed in claim 1, wherein the audio signal sections each is generated by frequency modulation synthesis.

11. The hearing aid as claimed in claim 1, wherein the audio signal sections each is generated from a sampled value representing an audio signal amplitude value at a sampling instant.

* * * * *